US005692967A

United States Patent [19]

Guyer

[11] Patent Number: 5,692,967

[45] Date of Patent: Dec. 2, 1997

[54] GOLF PRACTICE DEVICE

[76] Inventor: Donald M. Guyer, 1819 N. Case St., Orange, Calif. 92665

[21] Appl. No.: 679,232

[22] Filed: Jul. 12, 1996

[51] Int. Cl.[6] ..... A63B 69/36

[52] U.S. Cl. ..... 473/262; 473/263; 473/278

[58] Field of Search ..... 473/278, 279, 473/262, 263

[56] References Cited

U.S. PATENT DOCUMENTS 4,130,283 12/1978 Lindquist ..... 473/278 X 4,932,663 6/1990 Makar ..... 473/278 X

*Primary Examiner*—George J. Marlo

*Attorney, Agent, or Firm*—Albert O. Cota

[57] ABSTRACT

A golf practice turf simulating mat which has a raised support frame (22) with a bottom panel (36) and one end open. A mat tray (38) is located within the frame and includes a set of casters (40) that roll on descending ramps (28) and (30) that are attached to the frame. When a golf ball (26) is hit from the mat, the combined mat and tray deflect downwardly, the mat slides forward partially off of the tray and the tray rolls down the ramps descending below the top level of the frame. A rebound retraction system and mat return apparatus return the mat and tray to their original position. A second embodiment replaces the casters with sheaves (82) mounted on axles (84) penetrating inclined slots (80) in the frame for the downward and forward directional orientation of the tray within the frame.

19 Claims, 4 Drawing Sheets

FIG. 1

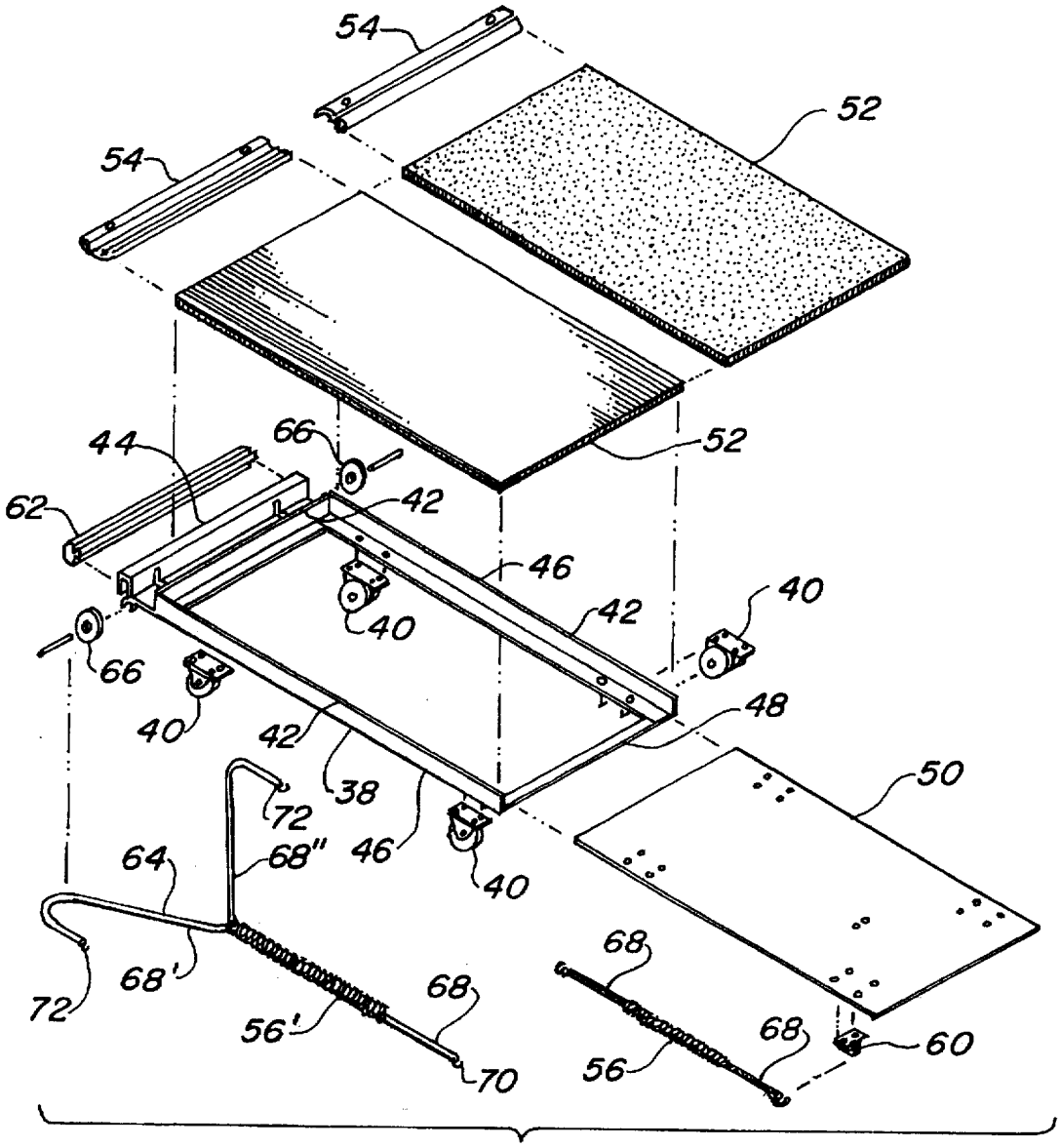
FIG. 11
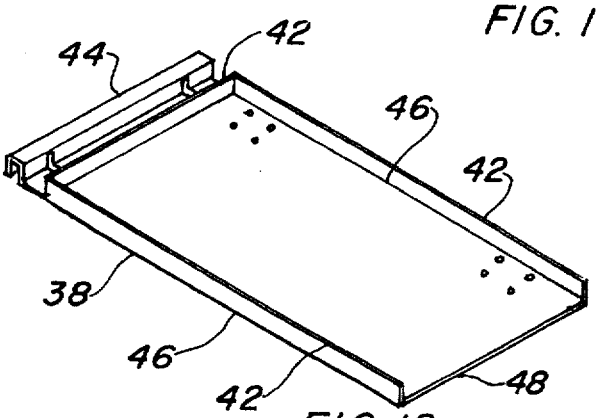
FIG. 12
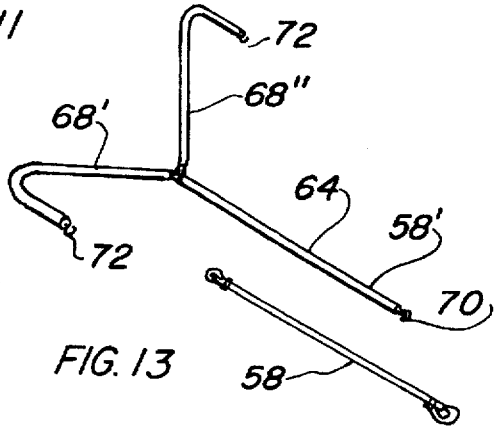
FIG. 13
FIG. 14

GOLF PRACTICE DEVICE

TECHNICAL FIELD

The invention pertains generally to golf practice apparatuses and more particularly to a golf practice mat that slides forward and down when struck with golf club to simulate the actual feel of a divot being displayed from natural turf.

BACKGROUND ART

Previously, many types of golf practice devices have been used in endeavoring to provide an effective means for producing natural effects. These practice devices are especially useful during driving workouts, which perfect one's swing in developing distance and accuracy.

Prior art is replete with structures utilizing movable and resilient mats suspended or spring loaded, that move downward when struck with a golf club. Further, others utilize a continuous belt or the like that actually move the mat forward when struck. While these inventions provide a shiftable surface that yields when struck with the club, obtaining the precise feel of natural turf is still unavailable. Thus, creating a long felt need for a natural turf simulating mat having realistic "grass-like" qualities, along with sufficient endurance to be practical.

A search of the prior art did not disclose any patents that read directly on the claims of the instant invention, however, the following U.S. patents are considered related:

| PATENT NO. | INVENTOR | ISSUED | |
|---|---|---|---|
| 4,955,611 | Moller | 11 September | 1990 |
| 4,932,663 | Makar | 12 June | 1990 |
| 4,875,685 | Ballinger, et al | 24 October | 1989 |
| 4,311,312 | O'Brian | 19 January | 1982 |
| 4,130,283 | Lindquist | 19 December | 1978 |
| 3,712,628 | Boss, Jr. | 23 January | 1973 |
| 3,639,923 | Stewart | 8 February | 1972 |
| 3,423,096 | Tone | 21 January | 1969 |
| 3,142,487 | Portteus | 28 July | 1964 |

Moller in U.S. Pat. No. 4,955,611 teaches a golf practicing device utilizing a mat that floats on a fluid contained within a bladder.

U.S. Pat. No. 4,932,663 issued to Makar discloses an artificial turf mat retained in a rigid frame that is spring loaded in tension with coiled extension springs. In one embodiment an elastic support bed is employed and in another, specific surfaces may be selected for simulation.

U.S. Pat. No. 4,875,685 issued to Ballinger, at al discloses a platform for a golfer to stand on and a main frame adjacent thereunto. An inner frame covered with a turf simulating surface is hinged on arms that pivot forward and down when the club head impact causes a wrinkle to be formed in the surface, originating the arcuate action. A ball storage ramp is attached to the main frame and the platform folds with the mainframe to form a carrying case.

U.S. Pat. No. 4,311,312 issued to O'Brian discloses a synthetic grass pad mounted within a frame by resilient members connected to front and rear portions of a frame. The resilient members are cloth covered rubber cords attached to the frame by pulleys.

U.S. Pat. No. 4,130,283 issued to Lindquist discloses a device with artificial turf secured to a cushioned, movable support. A separate section of the turf slides forward when struck by a club and is spring-loaded to return. Only compression of the turf is provided in a downward direction.

U.S. Pat. No. 3,712,628 issued to Boss, Jr. discloses a rigid housing containing horizontally mounted rollers upon which an endless belt, having simulated grass, is slidably mounted. A padded platform beneath the upper portion of the belt pivots on one end suspended by an elastic support member.

U.S. Pat. No. 3,639,293 issued to Stewart discloses a golf practice platform that is divided into two sections, one stationary and the other tilts slightly when the golfer's weight shifts. The entire platform may be tilted at various angles to simulate uphill, downhill, etc. The hitting surface is covered with artificial turf over a pad of cellular elastomeric material.

For background purposes and as indicative of the art to which the invention relates reference may be made to the U.S. Pat. No. 3,423,096 issued to Tone and U.S. Pat. No. 3,142,487 issued to Portteus.

DISCLOSURE OF THE INVENTION

Prior art has attempted to solve the problems inherent with current artificial turf practice mats used for the game of golf. The use of artificial turf is preferred for these practice mats since it has the look of natural grass, is relatively durable and available in a variety of densities and backing materials. While the artificial turf has these qualities, it is lacking in the feel of natural grass. When grass is struck by a club in a normal shot without a tee, the club strike the turf slightly below the ball causing the turf to breakaway in a divot. It is plainly seen that artificial turf does not have this capability, instead when hit there is considerable drag as the surface is resilient. Further, particularly on commercial applications such as golf driving ranges, the feel of natural turf becomes very important and artificial turf does not by itself provide a satisfactory solution.

It is therefore a primary object of the invention to augment the surface of the artificial turf to react to the impact of the club thereon. The first reaction to the impact is to move the entire surface forward, rather than dragging through the fibers of the artificial turf. This effect is accomplished by installing the artificial turf mat loosely in a tray that has an upstanding rim on both the sides and one end, and that is open on the other end. The mat is then free to slide in the tray away from the club when the mat is struck. This movement is instantaneous and is restricted only by the friction created from the mat on the tray, and a flexible elastic line that expands under the the mat and retracts to pull the mat back into place. This linear movement may be controlled in its resistance and length of travel by selection of the resilient material in conjunction with the elastic qualities of the line.

The second object of the invention is the construction material and configuration of the tray itself as it actually bows or bends downward when struck. It is therefore sufficiently resilient to yield under the impact pressure but not break. This feature is accomplished by the utilization of a thin thermoplastic sheet having an upstanding rim on the two sides and on one end and with an extruded aluminum designed so such that they unitedly flex with sufficient magnitude to provide this dynamic feature.

The third combined reaction allows the entire tray to move forward and downward, thus out of the way of the arcuate travel direction of the club head. This movement is created by the use of casters mounted under the tray, and resting on downward descending ramps. The impact slides the entire tray forward and away from the club. The ramps are angled to allow the front to drop at a steeper angle than the back. Thus, allowing the entire tray to slope down and away.

In order to prevent a shock, due to the sudden stop of the tray, an elastic band or extension spring is used. The band or spring eliminates this shock and affords a means to retract the tray to its original position.

It can easily be seen that the invention has progressed well beyond the prior art. The invention has developed the feel of natural turf, as the drag is compensated for by resiliency of the tray and forward movement of both the mat and tray. An optimum relationship may also be achieved by selection of materials and elastic qualities of bands or springs.

An important object of the invention is that with this resultant motion within the device itself, dynamically leaving the artificial turf, the shock to the golfer's hands, wrists, arms and back are greatly reduced. This feature is particularly apparent when the golfer makes a fat shot, actually hitting directly under the ball or a sculled shot, bouncing into the ball. Even on natural turf this type of shot transfers undue percussion forces to the human body, however, the invention minimizes this effect due to its elastic and supple yielding motion.

Another object of the invention is directed to the useful life of the apparatus. While even with prior art the basic structure is inherently durable however, the weak link in all systems utilizing artificial turf is that in time and with constant use, wear cannot be avoided. The fibers of the artificial turf are sturdily imbedded in a resilient mat backing, however, under constant battering they may be loosened and subsequently fall out. Further, the backing is usually made of a closed cell blown sponge material which has compressive elasticity and has spring-like qualities. However, under constant impact by a heavy club, particularly when fat shots are repeated, the material will split and once the surface is torn, further use will remove bits and pieces until a hole appears and the mat becomes useless. The present invention anticipates wear, which is inevitable, by placing two mats back to back and removably attaching them at one end. This arrangement provides four surfaces on each assembly, thus, when one surface becomes worn, the mat is simply reversed end for end since in most cases the wear occurs near the leading edge. The entire mat combination may also be turned upside down, thus providing two additional surfaces without having to replace the mat. With this in mind, for commercial applications, particularly driving ranges where use is constant, each mat assembly has four times the useful life of a single prior art mat.

Still another object of the invention is its adaptability to any type of platform for the golfer to stand on while using the invention. The mat apparatus is simply mounted adjacent to the platform and may or may not be attached as long as they are contiguous with each other. This feature permits the use of portable, stationary or fixed platforms with the only limitation the height remain the same. This flexibility is important in that the user is not required to obtain the platform from the same source and is not restricted in selection for the specific application.

These and other objects and advantages of the present invention will become apparent from the subsequent detailed description of the preferred embodiment and the appended claims taken in conjunction with the accompanying drawings.

Figure 9:
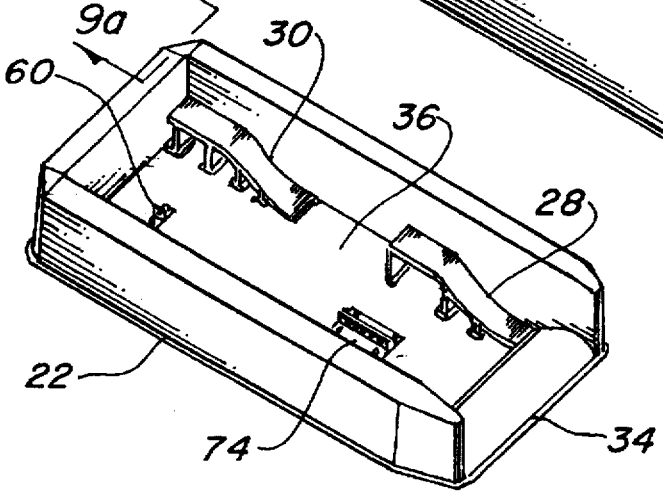

FIG. **9*a* is a cross-sectional view taken along lines 9*a*—9*a* of FIG. 9** illustrating the welded mitered corner.

FIG. 9 is a partial isometric view of the support frame completely removed from the invention for clarity with the ramps and bottom attached.

Figure 10:
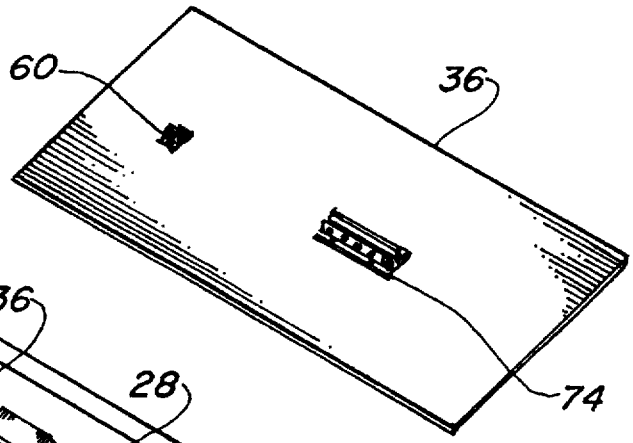

FIG. 10 is a partial isometric view of the support frame bottom completely removed from the invention for clarity.

FIG. 11 is an exploded view of the tray, mat, rebound retraction means and mat return means.

FIG. 12 is a partial isometric view of the tray in the thermoplastic embodiment completely removed from the invention for clarity.

FIG. 13 is a partial isometric view of the rebound retraction means in the elastic tube or band embodiment.

FIG. 14 is a partial isometric view of the preferred embodiment mat return means in the elastic tube or band embodiment.

Figure 15:
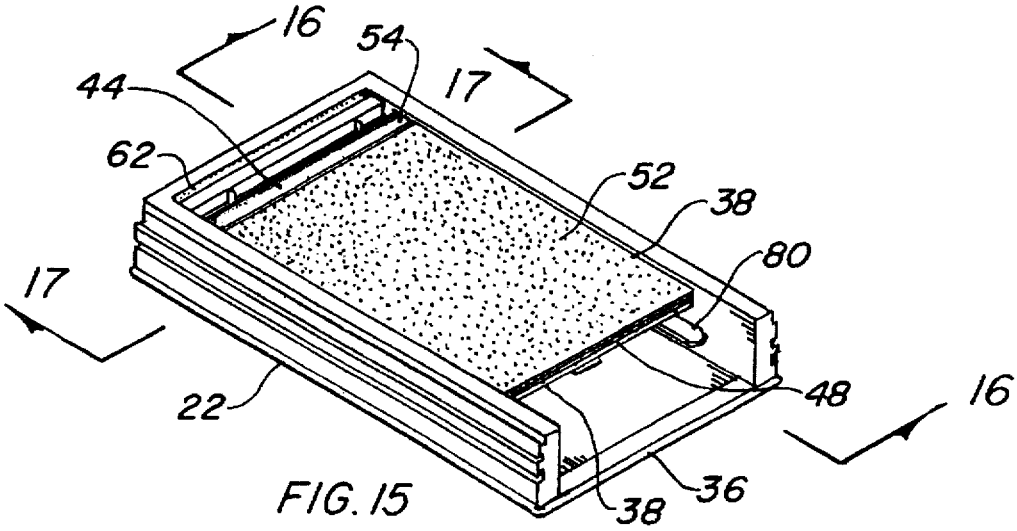

FIG. 15 is a partial isometric view of the invention with ramps means integral with the support frame.

Figure 16:
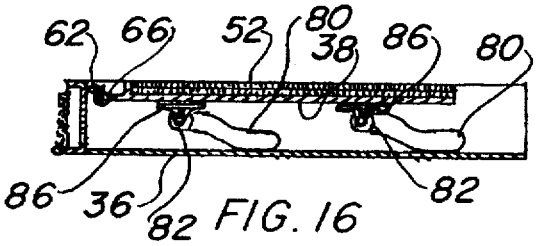

FIG. 16 is a cross sectional view taken along lines 16—16 of FIG. 15.

Figure 17:
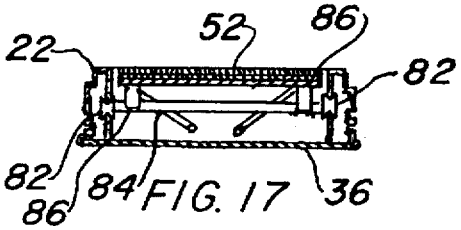

FIG. 17 is a cross sectional view taken along lines 17—17 of FIG. 16.

Figure 18:
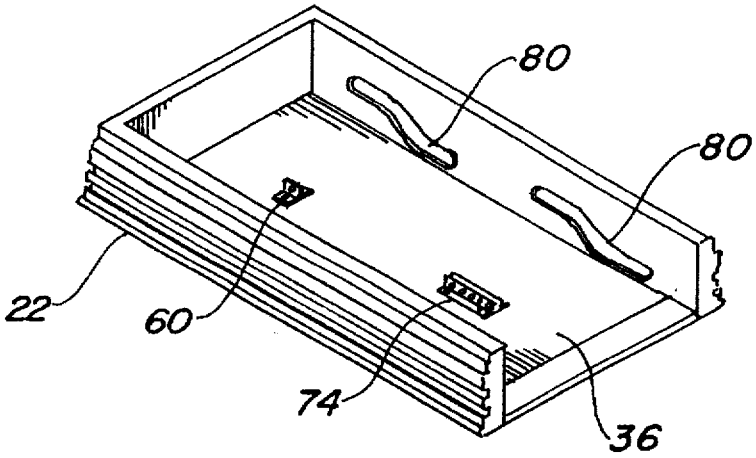

FIG. 18 is a partial isometric view of the support frame in the integral ramp means embodiment completely removed from the invention for clarity.

Figure 19:
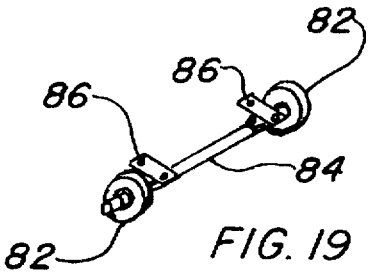

FIG. 19 is a partial isometric view of the sheave, axle and mounts yoke for the integral ramp means embodiment completely removed from the invention for clarity.

Figure 20:
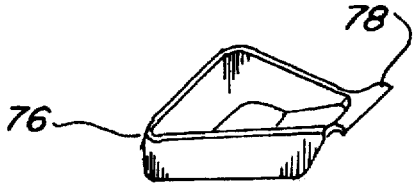

FIG. 20 is a partial isometric view of the ball retainer completely removed from the invention for clarity.

BEST MODE FOR CARRYING OUT THE INVENTION

The best mode for carrying out the invention is presented in terms of a preferred and second embodiment. Both embodiments are generally designed alike except the second embodiment replaces the ramp and casters with a slotted ramp integral with the support frame into which four casters are positioned.

Figure 1:
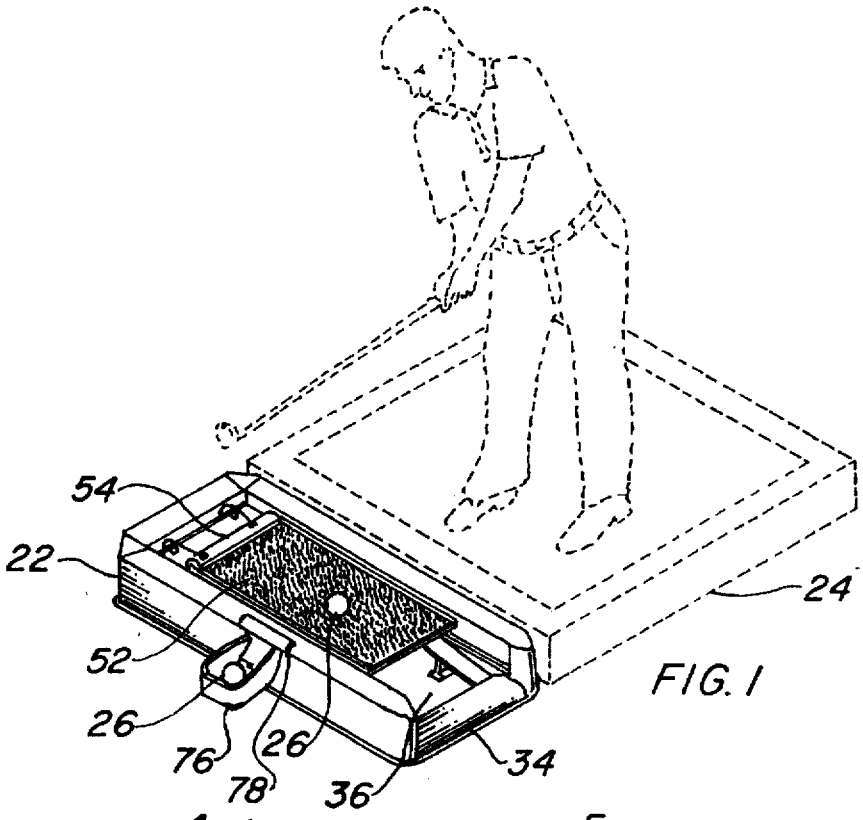
FIG. 1 is a partial isometric view of the preferred embodiment including a golfer on a platform shown in dotted lines.
Figure 2:
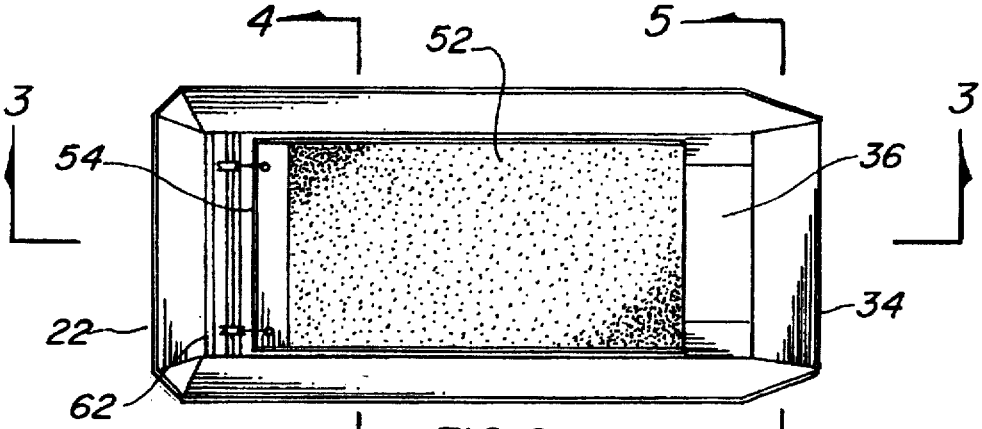
FIG. 2 is a plan view of the preferred embodiment in its at rest position.
Figure 3:
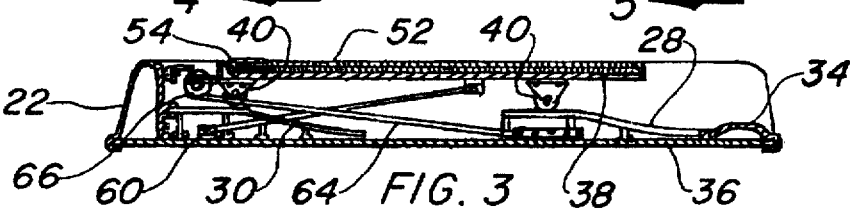
FIG. 3 is a cross sectional view taken along lines 3—3 of FIG. 2.
Figure 4:
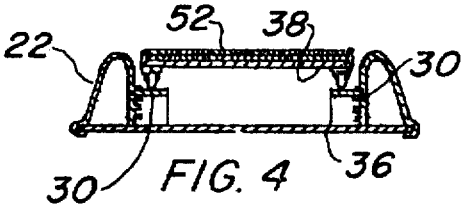
FIG. 4 is a cross sectional view taken along lines 4—4 of FIG. 2.
Figure 5:
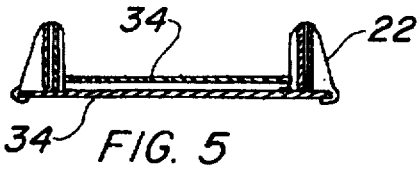
FIG. 5 is a cross sectional view taken along lines 5—5 of FIG. 2.

The preferred embodiment, as shown in FIGS. 1–14 and 20, is comprised of a support frame 22 that is installed parallel to and juxtapositioned on one side of a platform 24. The arrangement is best illustrated in FIG. 1 with a golfer standing on the platform addressing a golf ball 26. The golfer and platform 24 are shown with dotted lines as they are not part of the invention. It should be noted however, that the platform 24 may be any type suitable for the application i.e., fixed, portable, or a permanently built in structure preferably covered on the top with artificial turf. The horizontal surface of the platform 24 should also be the same height as the support frame 22, to simulate the natural conditions of a golf course.

The support frame 22 may be similar in length to the platform 24, as illustrated, and is preferably made of aluminum extrusions, however, any other suitable material and method of construction may be used including vacuum-formed thermoplastic or the like. If the preferred material is employed, attachment is made by welded mitered corners 23. Also, exposed ends may be saw-cut and bent inward to close the gap and then welded and ground to produce a finished closure. Ramp means in the form of a pair of forward ramps 28 and a pair of aft ramps 30 are joined integrally with the frame 22, as shown in FIG. 9. These ramps 28 and 30 may be made of flat sheet material formed into the desired shape and welded into place, however, extruded shapes are preferably snapped into recesses within the frame 22 base structure as illustrated. The angle of descent is steeper on the forward ramps 28 than the aft ramps 30 as depicted in FIGS. 3, 6–8 and 9. This design has an effect on the operational characteristics of the invention. The frame 22 is in a U-shape, with sides and back made of the same structural material. The front of the frame is joined to the sides with a hollow arched member 34 along the lower surface, as best depicted in FIG. 9. The arched member 34 is also an aluminum extrusion snapped into recesses within the frame 22 in the same manner as the ramps, additional welding may be used for positive securement if desired.

A bottom panel 36 completes the frame structure and is preferably retained by indentations within the frame 22. FIG. 10 shows the bottom panel 36 along with attachments connected on the top surface. The panel 36 may be made of any material such as metal, wood, fiberglass or the like, with thermoplastic in sheet form preferred.

Any type of attachment may be used between the support frame and the platform 24. The type used depends on the configuration and type of platform to be used. This connection would employ conventional fasteners and methods well known in the art.

Figure 6:
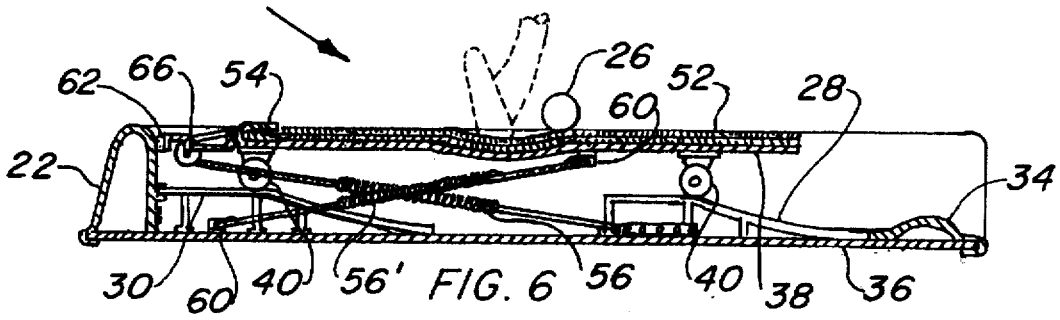
FIG. 6 is a cross sectional view of the preferred embodiment taken along the centerline with the tray in its at rest position.
Figure 7:
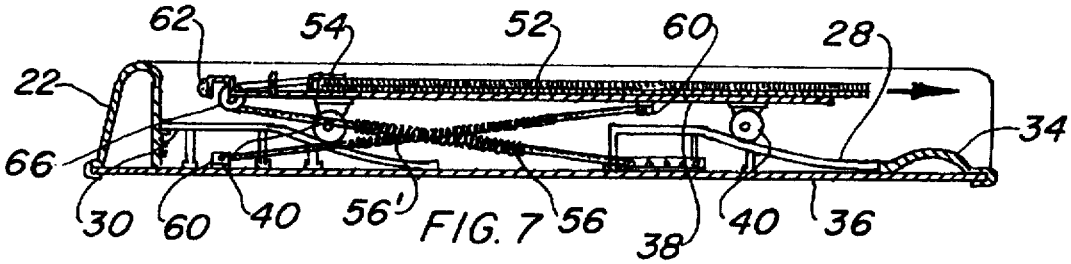
FIG. 7 is a cross sectional view of the preferred embodiment taken along the centerline with the tray in its partially extended position.
Figure 8:
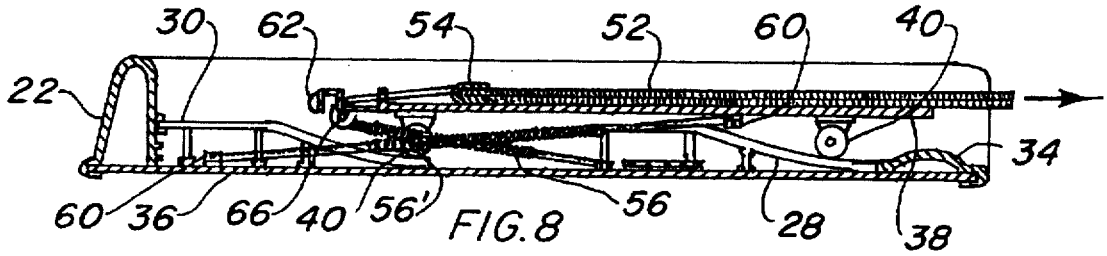
FIG. 8 is a cross sectional view of the preferred embodiment taken along the centerline with the tray in its fully extended position.
Figure 9A:
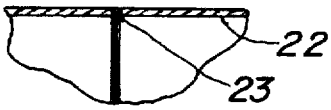

A rolling mat tray 38 is positioned within the frame 22 on the ramps 28 and 30 and rests on four casters 40 that are attached underneath the tray. The casters 40 are of the rigid type with beatings and rubber, polyurethane, phenolic or cast iron wheels. The casters 4O permit the tray 38 to move forward following the downward slope of the ramps 28 and 30, as shown in FIGS. 6–8, lowering the tray below the top of the support frame 22. The mat tray 38 for containment, further includes a upstanding rim 42 on both sides and on the aft end, as depicted in FIGS. 11 and 12. Preferably, the tray 38 is fabricated using aluminum extrusions with an aft end 44, angular sides 46 and a flat forward end 48 welded together or screwed using notches within the extrusions. A flat, thermoplastic tray bottom 50 is attached with fasteners or captivated by notches in the extrusions as illustrated. The assembled tray 38 is flexible enough to yield to a spring force in an opposite direction without breaking when struck by a golf club. Thermoplastic may be used as a material for the entire tray, as shown in FIG. 12, using vacuum forming as a manufacturing technique in an alternate embodiment.

A double sided mat 52 is slidably disposed within the mat tray 38 in alignment with the upstanding rim 42. The mat 52 consists of a pair of rectangular sections of artificial turf juxtapositioned back to back with its fibrous tuffs exposed outwardly. This arrangement places the outward surface with the nape exposed on the top and a like surface on the bottom creating a surface that will easily slide on the tray 38. The foam backing of each portion is therefore enclosed, permitting only the fibrous working surface to be exposed. A clamp 54 holds the double sided mat 52 captive and is formed of two halves screwed together in tension with teeth grasping and compressing the mat, as shown in FIG. 11. Aluminum extrusions are the preferred material and form, however any type of construction and alternate material may also be used.

Tray rebound retraction means return the tray 38 to its reset position after being driven forward. One method of retraction is illustrated in FIG. 11, which incorporates a tension spring 56 by itself or connected between two flexible lines 68, in either case the spring is attached between the frame 22 and the tray 38. Another embodiment of the rebound retraction means is depicted by itself in FIG. 14 and consists of an elastic member 58 such as a rubber band or hollow resilient tube i.e., a surgical tube. Either embodiment may include a line 68 of fabric or plastic for ease of connection. In order to attach the ends of the retraction means to the tray 38 and frame 22, a pair of brackets 60 are preferably employed. Each bracket 60 may be formed in almost any shape such as angular, offset, eye shape etc., with a "T" shape preferred. The brackets 60 may be extruded into the preferred shape, with mounting and attachment holes drilled after cutting the extrusion to length. Fastening to the structure may be of any means well known in the art such as rivets, screws, nuts and bolts, etc.

It will be noted that the retraction means will hold the tray 38 tightly against the frame 22 at rest and when driven forward will pull the tray back up the ramps 28 and 30 until it interfaces with the frame. In order to absorb the shock as it returns, a resilient cushion 62 is preferably installed along the entire width of the aft end 44. This cushion 62 is dovetailed into a groove in the aft end extrusion or, alternatively, a strip of sponge foam or rubber bumps may be added in other embodiments.

The double-sided mat 52 is positioned on the tray 38 between the three portions of the upstanding rim 42 and held together with the mat clamp 54. A mat return means restores the mat 52 to a reset position on the tray after the tray is slid forward by the impact from the golfer swinging a golf club and hitting the ball 26 from the mat. The mat return means are illustrated in FIGS. 3, 6–8, 11 and 13 and constitute a Y-shaped lanyard and at least one, but preferably two pulleys 66 mounted on one end of the tray 38. The lanyard 64 is made of a coiled tension spring 56' attached to a flexible line 68 on one leg of the Y and flexible lines 68' and 68" on the opposite ends 72. The single leg end or first end 70 of the lanyard is attached directly to the frame bottom panel 36 by the use of a multi-position bracket 74. This bracket 74 has a number of bores through vertical legs making the bore selection the adjustment method to optimize the amount of movement of the mat 52 on the tray bottom 50. The bracket 74 may be any configuration desired, however, a tee shape is preferred that is constructed of an aluminum extrusion, as shown in FIG. 10. It will be easily seen that when the mat 52 is driven forward, the spring 56' is expanded and by its memory, slides the mat back into the reset or at rest position.

Another embodiment of the mat return means is illustrated by itself in FIG. 13. This embodiment consists of an elastic member 58' such as a piece of rubber band or hollow surgical tube attached at the transition thus forming the Y-shape of the lanyard 64. For ease of connection, a line 68 may be added to the front end 70 of the lanyard 64.

A ball retainer 76 is clamped over the frame 22 with a U-shaped lip 78 for storage and easy access to the golf balls 26. This retainer 76 is shown attached in FIG. 1 and by itself in FIG. 20. The clamping lip 78 permits the retainer 76 to be removed and relocated to the desired position by the golfer. Any type of construction may be used for this retainer 76, such as molded fiberglass, plastic or vacuum-formed thermoplastic sheet.

The second embodiment of the invention is illustrated in FIGS. 15–19 and utilizes the exact same mat 52 and tray 38 with its accompanying rebound retraction means and mat return means. The only difference in this second embodiment is the ramp means wherein the casters 40 and ramps 28 and 30 are replaced with sheaves penetrating slots integral with the frame 22. In the second embodiment, the frame may be the same shape as previously described and illustrated or in a hollow rectangular shape, as depicted in FIGS. 15–18. In any event, four inclined slots 80 are incorporated into the support frame 22, as shown in FIG. 18. These slots 80 have the same incline as the ramps 28 and 30 except they are slightly elevated. A sheave 82 mounted on an axle 84 penetrates each slot 80 and is held in place by the groove in the sheave 82 riding into the bottom edge of the slot 80. The sheave 82 is employed in pairs with two penetrating opposite slots 80 near the aft end 44 of the tray 38 and the remaining two penetrating the slots 80 near the forward end 48. The two axles 84 are attached to the bottom of the tray 38 with a pair of yokes 86, as best illustrated in FIG. 19. Each yoke 86 includes a flat mounting surface on the top and a radial jaw on the bottom to interface with the axle 84. When this embodiment is in operation, the sheaves 82 are resting on the bottom edge of the slots 80 and permit movement of the tray in exactly the same manner as the preferred embodiment.

It will be noted that attaching hardware for the brackets 60, 74, casters 40 and yokes 86 have been omitted from the drawings, as any fastening means may be employed that are commonly used and well known to one skilled in the art.

In use, the turf simulating mat is positioned adjacent to a platform 24 and the ball retainer 76 is clamped to the frame 22 at a convenient location. The golfer positions a ball 26 on the mat 52 and is driven with a club. When the head of the club strikes the mat 52, the resiliency of the tray 38 upon which the mat rests permits the tray to bow downward and away from the impact point while simultaneously sliding the mat forward on the tray and rolling the entire tray forward and down such that the tray descends below the club's arc of travel. Rebound retraction and mat return means restore the tray 38 and mat 52 to their original at rest position ready for the next stroke.

It will be noted that while the preferred construction techniques have been mostly directed toward aluminum extrusions, any type of material or fabrication methods may be used with equal ease. In fact, vacuum-formed plastic construction has been employed successfully.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

I claim:

1. A golf practice turf simulating mat disposed adjacent to a platform for supporting a golfer comprising:

a) a support frame having ramp means integral therewith, contiguously engaging the platform on one side, b) a rolling mat tray movably arranged within the support frame, c) a double sided mat slidably disposed within the mat tray such that when a golfer strikes a ball placed on the mat, with a club, and the club head impacts the mat and ball with sufficient force, the ball and tray move simultaneously in the same direction and the tray rolls down the ramp means and the mat slides outwardly on the tray to simulate a feel of a divot being removed from natural turf, d) tray rebound retraction means for returning the tray to a reset position after being driven forward, and e) mat return means for restoring the mat to a reset position upon the tray after being slid forward by impact from a golfer hitting a ball from the mat.

2. The golf practice turf simulating mat as recited in claim 1 wherein said support frame is extruded aluminum with welded mitered corners.

3. The golf practice turf simulating mat as recited in claim 1 wherein said support frame further comprises a thermoplastic bottom panel retained by indentations in the frame.

4. The golf practice turf simulating mat as recited in claim 1 where said rolling mat tray further comprises a plurality of casters engaging said ramp means so positioned that in use the tray follows a downward slope of the ramp means.

5. The golf practice turf simulating mat as recited in claim 1 wherein said rolling mat tray is flexible enough to yielding spring in an opposed direction without breaking when struck by a golfer.

6. The golf practice turf simulating mat as recited in claim 5 wherein said rolling mat tray is thermoplastic.

7. The golf practice turf simulating mat as recited in claim 5 wherein said rolling mat tray includes an extruded aluminum frame and thermoplastic bottom.

8. The golf practice turf simulating mat as recited in claim 1 wherein said rolling mat tray further comprises a pair of axles containing rotatable sheaves each attached to an end of the tray with the sheaves movably contained within the ramp means.

9. The golf practice turf simulating mat as recited in claim 8 wherein said rolling mat tray includes an extruded aluminum frame and thermoplastic bottom.

10. The golf practice turf simulating mat as recited in claim 1 wherein said double sided mat further comprising a pair of rectangular sections of artificial turf juxtapositioned back to back with fibrous tuffs exposed outwardly.

11. The golf practice turf simulating mat as recited in claim 10 further comprising a clamp holding the double sided mat captive.

12. The golf practice turf simulating mat as recited in claim 1 wherein said rebound retraction means further comprises a coiled tension spring attached between the frame and the tray.

13. The golf practice turf simulating mat as recited in claim 1 wherein said rebound retraction means further comprises an elastic member attached between the frame and the tray.

14. The golf practice turf simulating mat as recited in claim 1 wherein said mat return means further comprises at least one pulley mounted on one end of the tray and a coiled tension spring attached to a flexible line positioned over the pulley with a first end attached to the mat and a second end attached to the support frame such that when the mat is driven forward the spring is expanded and by its memory slides the mat back into its reset position.

15. The golf practice turf simulating mat as recited in claim 1 wherein said mat return means further comprises at least one pulley mounted on one end of the tray and an elastic band attached to a flexible line positioned over the pulley with a first end attached to the mat and a second end attached to the support frame such that when the mat is driven forward the elastic band is expanded and by its memory slides the mat back into its reset position.

16. The golf practice turf simulating mat as recited in claim 1 further comprising a ball retainer contiguously engaging the frame for storing golf balls.

17. The golf practice turf simulating mat as recited in claim 16 wherein said ball retainer is vacuum formed thermoplastic.

18. A golf practice turf simulating mat disposed adjacent to a platform for supporting a golfer comprising:

a) an extruded aluminum support frame with a thermoplastic bottom further having ramp means integral therewith, b) a resilient rolling mat tray, having a plurality of sheaves, movably arranged within the support frame with the sheaves engaging the ramp means, c) a double sided artificial turf mat comprising a pair of identical segments positioned back to back with tuft exposed slidably positioned within the mat tray such that when the golfer strikes a ball placed on the mat, with a club, and the club head impacts the mat and ball with sufficient force, the ball and tray move simultaneously in the same direction and the tray rolls down the ramp means and the mat slides outwardly on the tray to simulate the feel of a divot being removed from natural turf, d) tray rebound retraction means for returning the tray to a reset position after being driven forward, and e) mat return means for restoring the mat to a reset position upon the tray after being slid forward by impact from the golfer hitting a ball from the mat.

19. The golf practice turf simulating mat as recited in claim 18 further comprising a ball retainer contiguously engaging the frame for storing golf balls.

* * * * *